US012768613B1

(12) United States Patent
Viken

(10) Patent No.: US 12,768,613 B1
(45) Date of Patent: Oct. 20, 2026

(54) TIRE DEFLATION SYSTEM AND METHOD OF USE

(71) Applicant: Matthew Viken, Flower Mound, TX (US)

(72) Inventor: Matthew Viken, Flower Mound, TX (US)

( * ) Notice: Subject to any disclaimer, the term of this patent is extended or adjusted under 35 U.S.C. 154(b) by 0 days.

(21) Appl. No.: 19/311,723

(22) Filed: Aug. 27, 2025

Related U.S. Application Data

(63) Continuation of application No. 19/049,818, filed on Feb. 10, 2025, now abandoned.

(60) Provisional application No. 63/723,232, filed on Nov. 21, 2024, provisional application No. 63/689,032, filed on Aug. 30, 2024.

(51) Int. Cl.
*E01F 13/12* (2006.01)
*F41B 11/83* (2013.01)

(52) U.S. Cl.
CPC ..... *F41B 11/83* (2013.01); *E01F 13/12* (2013.01)

(58) Field of Classification Search
CPC ..... E01F 13/12; E01F 13/123; F41B 11/83
USPC ..... 404/6
See application file for complete search history.

(56) References Cited

U.S. PATENT DOCUMENTS 7,275,889 B1 * 10/2007 McGill ..... E01F 13/12 404/6
7,895,788 B1 * 3/2011 Cilia ..... F41G 1/473 42/106
8,418,624 B2 * 4/2013 McGarraugh ..... F42B 12/365 102/500

FOREIGN PATENT DOCUMENTS

GB 2452711 A * 3/2009 ..... F42B 6/02

* cited by examiner

*Primary Examiner* — Reginald S Tillman, Jr.
(74) *Attorney, Agent, or Firm* — Richard Eldredge; Leavitt Eldredge Law Firm

(57) ABSTRACT

A tire deflation system, comprising of a body that is attached to the bottom of the brush guard of the police car and an opening to place a magazine with barbs meant to deflate the tire. The system is operated by a remote. The barb is sharp and circular and is placed inside the body and is deployed at the push of a button to prevent the culprit from escaping. The system is designed to blend seamlessly with the color of the brush guard, ensuring it remains discreet and is not easily visible during routine operations.

3 Claims, 2 Drawing Sheets

TIRE DEFLATION SYSTEM AND METHOD OF USE

BACKGROUND

1. Field of the Invention

The present invention relates generally to tire deflation systems and methods of use.

2. Description of Related Art

With the rise in crime rates, law enforcement agencies face increased pressure to apprehend criminals quickly. This often involves high-speed vehicle chases, which can be both time-consuming and risky. In such pursuits, there is a significant chance of losing the suspect, either due to the speed of the chase or the difficulty of maintaining pursuit over long distances and difficult terrains.

Current solutions for stopping fleeing vehicles often involve tire deflation systems, such as spike strips, which are placed on the road to deflate the tires during a pursuit or positioned in front of the suspect's vehicle when not actively in pursuit. While effective, these methods can be time-consuming and require significant coordination, additional personnel, and resources. Setting up these systems often takes valuable time, and deploying them safely and accurately can be challenging.

Accordingly, it is an object of the present application to provide a tire deflation system that can be installed under the brush guard of the police car and fired to deflate the suspected vehicles tires reducing the requirement of additional personnel and limitations mentioned above.

BRIEF DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
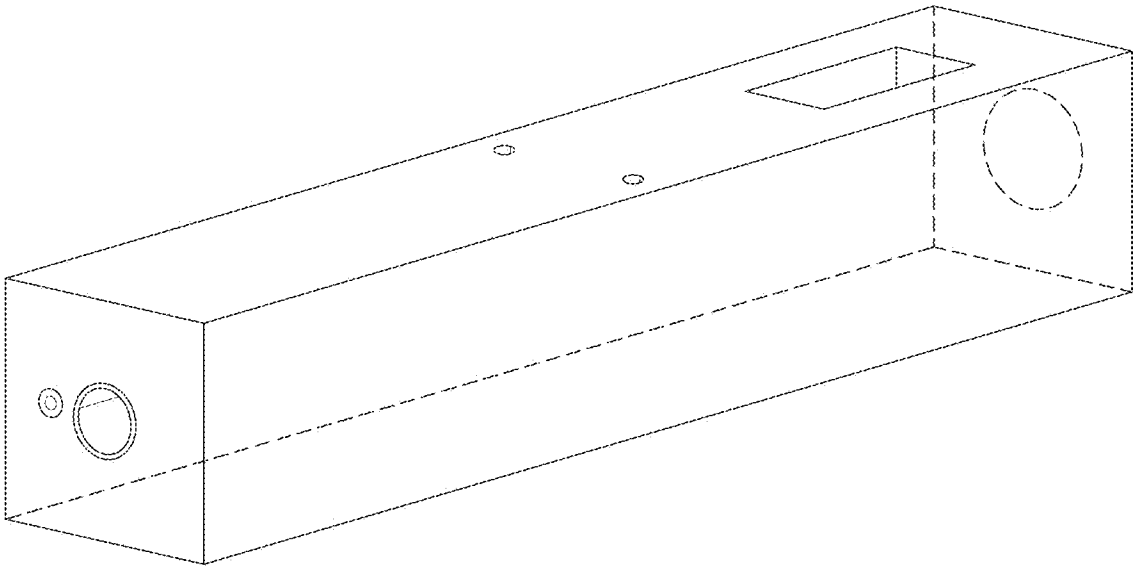
FIG. 1 is a perspective view of the barrel of the tire deflation system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION

Illustrative cases of the system and method of use of the present application are provided below. It will of course be appreciated that in the development of any actual case, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several cases of the system are presented herein. It should be understood that various components, parts, and features of the different cases may be combined together and/or interchanged with one another, all of which are within the scope of the present application, even though not all variations and particular cases are shown in the drawings. It should also be understood that the mixing and matching of features, elements, and/or functions between various cases is expressly contemplated herein so that one of ordinary skill in the art would appreciate from this disclosure that the features, elements, and/or functions of one case may be incorporated into another case as appropriate, unless described otherwise.

The preferred case herein described is not intended to be exhaustive or to limit the invention to the precise form disclosed. It is chosen and described to explain the principles of the invention and its application and practical use to enable others skilled in the art to follow its teachings The technology described herein fulfills a tire deflation system, comprising of a barrel 100 as shown in FIG. 1 configured to fit on the bottom of the brush guard by two holes for screws 101, 102 which secure the device into the brush guard at the bottom. The barrel may be made of rubber to prevent wear and tear. A stainless-steel tube is placed inside the barrel, and right next to the tube directly off to the right or left would be a green laser 103.

Figure 3:
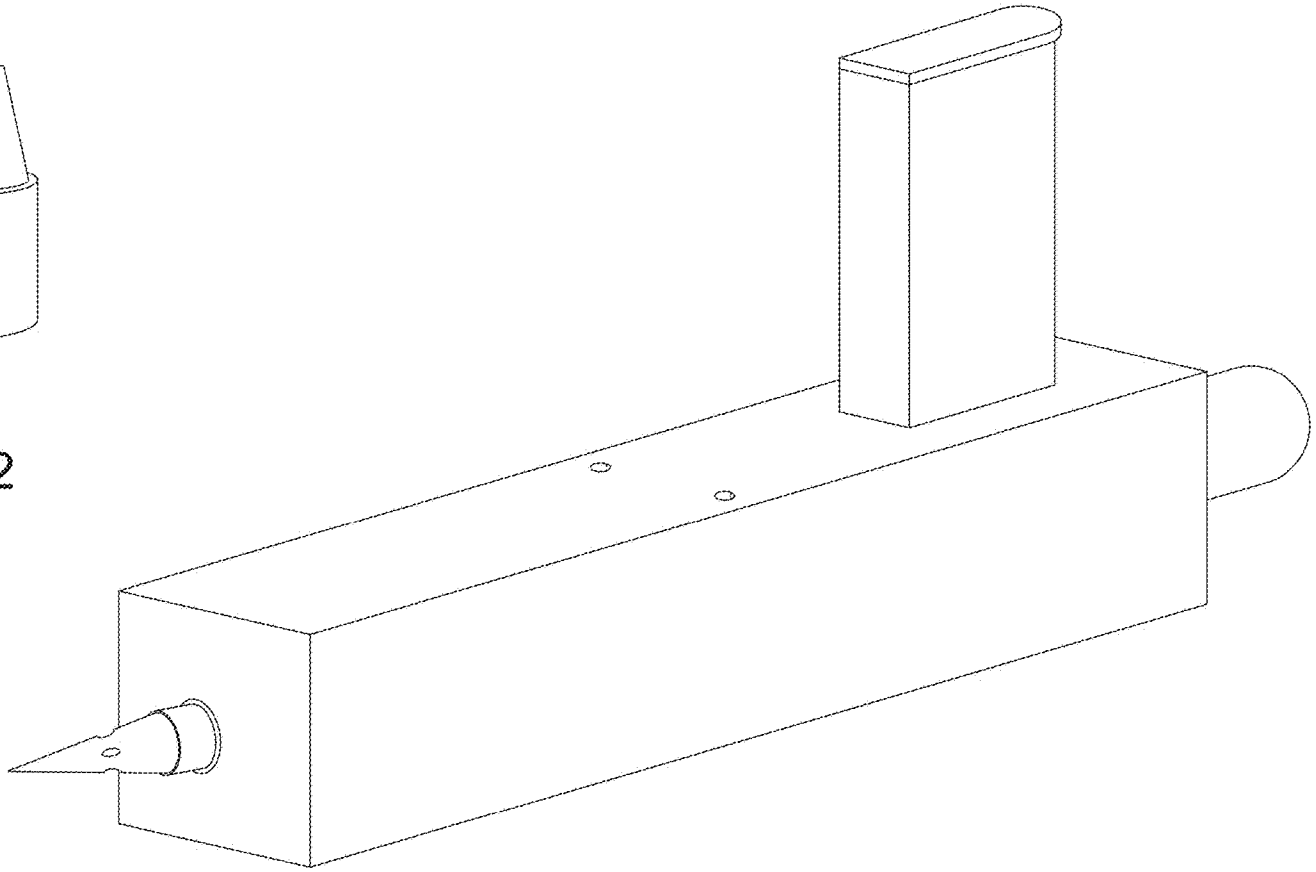
FIG. 3 is a perspective view of the tire deflation system.

The end of the top portion of the barrel has a rectangular opening 104 to place a magazine 120. The magazine would click in just like in a gun. It may be made of steel as it is easier to slide in and out of the rubber attachment. The magazine may hold 5-6 barbs. The back of the barrel would have an opening 105 to attach a CO2 Cartridge and opening 106 to place the barb as shown in FIG. 3.

The device would be turned on and off by electricity and can be selected to be on or off with a remote which will be placed in the vehicle with the officer. In addition, if the officer pulls someone over and has a feeling the car they pulled over would flee, they may line the car up with the tire of the car they pulled over, carry the remote with them as they walk up to the car and if the car takes off, they could launch it right there to take air out of the tire. A .22 caliber may be a good caliber of the force needed; however, it is not limited to.

Figure 2:
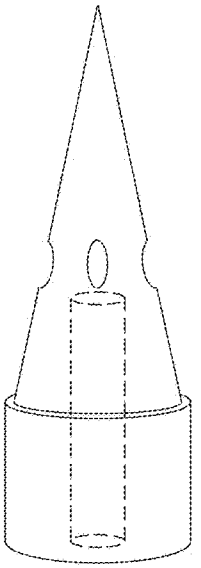
FIG. 2 is a perspective view of dart.

The barb 107 as shown in FIG. 2 may be 1½ to 2 inches in length in our preferred case. The head 108 is sharp and circular and has four holes 109,110,111,112 one for each side of the head. These holes lead into a body where there would be a chamber 113 that would lead out of the base of the barb. The barb is sharp on the top, hollow in the middle and a large circle is the base. It may be made of Teflon to keep the hole open after penetrating the tire.

The particular cases disclosed above are illustrative only, as the cases may be modified and practiced in different but equivalent manners apparent to those skilled in the art having the benefit of the teachings herein. It is therefore evident that the particular cases disclosed above may be altered or modified, and all such variations are considered within the scope and spirit of the application. Accordingly, the protection sought herein is as set forth in the description.

Although the present cases are shown above, they are not limited to just these cases but are amenable to various changes and modifications without departing from the spirit thereof.

What is claimed is:

1. A tire deflation system, wherein the system comprises:

a body configured to be attached to a bottom of a brush guard, wherein the body has a first opening configured to place a magazine and a second opening configured to attach a CO2 Cartridge; and a barb configured to deflate a tire, wherein the barb comprises of a head comprising of one or more holes leading to a chamber that would lead out of a base of the barb, wherein the barb is configured to attach to the body through a third opening.

2. The tire deflation system of claim 1, wherein the system can be turned on and off by a remote.

3. The tire deflation system of claim 1, wherein the head of the barb is sharp and circular to deflate the tire.

* * * * *